United States Patent [19]

Woods et al.

[11] 4,227,955

[45] Oct. 14, 1980

[54] ARTICLE TAPING SYSTEM

[75] Inventors: Quentin T. Woods; William D. Gerverdinck, both of San Jose, Calif.

[73] Assignee: FMC Corporation, San Jose, Calif.

[21] Appl. No.: 1,506

[22] Filed: Jan. 8, 1979

[51] Int. Cl.[2] ..... B31B 1/72; B31B 7/60

[52] U.S. Cl. ..... 156/269; 93/36.9; 93/1 TS; 156/289; 156/468; 156/489; 156/522; 156/530; 156/537; 156/378; 156/511

[58] Field of Search ..... 156/250, 289, 212, 468, 156/486, 489, 510, 511, 522, 530, 537, 566, 269, 378; 93/36.9, 1 TS

[56] References Cited

U.S. PATENT DOCUMENTS

| | | | |
|---|---|---|---|
| 2,643,016 | 6/1953 | Steckling | 156/489 |
| 2,653,727 | 9/1953 | Wagner et al. | 156/489 |
| 2,842,034 | 7/1958 | Tolf | 156/522 |
| 3,355,995 | 12/1967 | Borkmann et al. | 93/1 TS |
| 3,466,843 | 9/1969 | Mumper | 156/522 |
| 3,489,637 | 1/1970 | Gresl et al. | 156/521 |
| 4,073,119 | 2/1978 | Nelson | 156/522 |

*Primary Examiner*—Michael G. Wityshyn
*Attorney, Agent, or Firm*—R. S. Kelly; T. J. McNaughton

[57] ABSTRACT

A method and apparatus for applying segments of sealing tape to both ends of a carton and for forming pull-tabs at both ends of the segments of sealing tape so applied. Cartons are conveyed in indexed fashion at uniform intervals on a conveyor. Sealing tape is dispensed from two rolls and is applied to the ends of the cartons by lay-down rollers at the margins of the conveyor. The conveyor is indexed so as to stop the conveyor after a section of tape linking two adjacent cartons on the conveyor is provided at each end of the cartons. Short segments of masking tape are applied to the adhesive side of the sealing tape at specific locations thereon and at a station spaced upstream from the point where the sealing tape is applied to the cartons whereby after the sealing tape is applied to the cartons, the masking tape segments will be disposed on the linking sections of sealing tape midway between two adjacent cartons. The linking sections of sealing tape are then cut to sever the masking tape segments in half, and the several upstream and downstream halves of the linking sections of sealing tape are applied to the opposing front and rear side panels of the adjacent cartons. Pull-tabs, each comprising one-half of a masking tape segment, are thus formed at the ends of the sealing tape applied to the side panels of the cartons.

12 Claims, 9 Drawing Figures

FIG_6
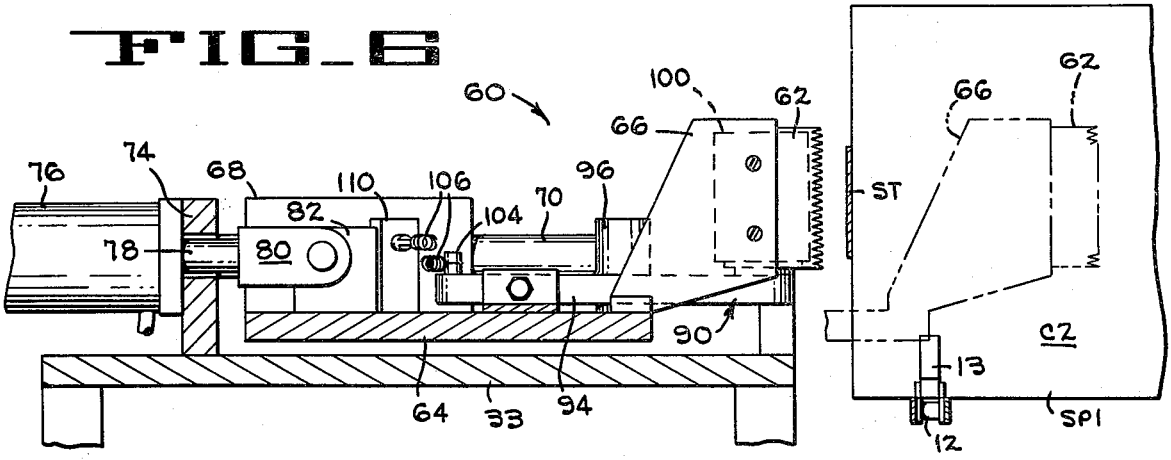
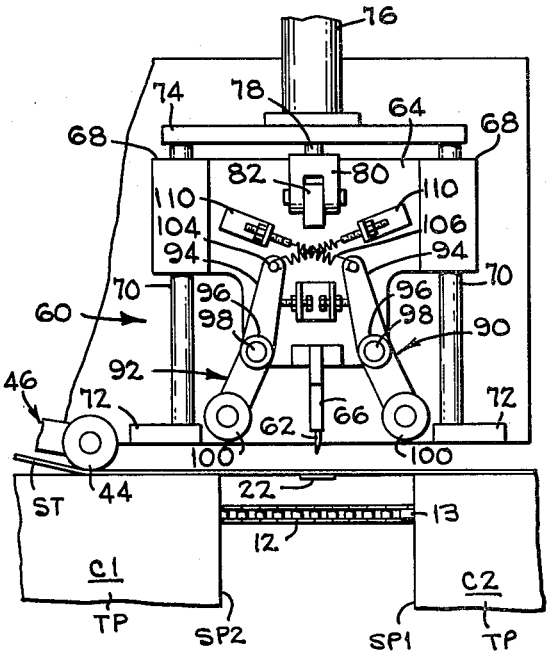
FIG_7
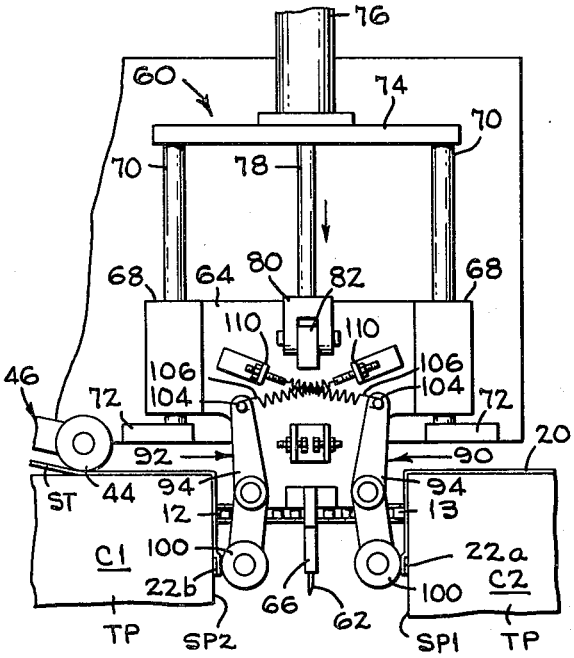
FIG_8

ARTICLE TAPING SYSTEM

BACKGROUND OF THE INVENTION

1. Field of the Invention

The present invention generally relates to a method and apparatus for applying sealing tape to a container. More particularly, the present invention relates to a method and apparatus for applying a segment of sealing tape to a container, such as a carton, so as to leave a pull-tab on at least one end of the segment of sealing tape.

2. Prior Art

In the past, sealing tape has been applied to cardboard cartons so as to leave a pull-tab portion at an end of the tape which may be easily grasped so as to tear the tape from the article. It is known, for example, that a segment of pressure-sensitive sealing tape has been applied to secure flaps at the ends of cartons and that the end portions of the tape segment have been manually folded back on themselves before pressing such ends of the tape against the adjacent side panels of the carton. The folded end portions, which of course will not adhere to the carton, form pull-tabs.

It will be appreciated that to minimize labor costs and increase productivity, it would be desirable to employ an apparatus for applying tape to a container which would form pull-tabs at the ends of the taps so that an operator is not required to manually fold back the ends of the tape.

SUMMARY OF THE INVENTION

The present invention provides a method of applying sealing tape to a container and for automatically forming a pull-tab at either one or both ends of the applied tape, as desired. The method includes the steps of dispensing tape from a roll of sealing tape, and applying short segments of masking tape to the adhesive side of the sealing tape at selected uniform intervals thereon to thereby form non-adhesive sections on the adhesive side of the sealing tape. The sealing tape is applied to a container, and the tape adhering to the container is cut at the end of, or through a masking tape segment, with such segment, or a part thereof, thereby forming a pull-tab. In a preferred embodiment, the sealing tape is severed through the center of a masking tape segment, with the half of the segment adhering to the trailing end of the sealing tape applied to a first container forming a pull-tab, and with the other half of such severed segment forming a pull-tab at the leading end of the sealing tape applied to the next container.

The present invention also provides a taping apparatus comprising an assembly for dispensing sealing tape, an assembly for applying segments of masking tape on the adhesive side of the sealing tape at selected intervals thereon, an assembly for applying the sealing tape having a masking tape segment thereon to a container, such as a carton, and an assembly for cutting the sealing tape adjacent or through a masking tape segment so as to leave a pull-tab at such cut end of the sealing tape. The masking tape applicator assembly includes a mechanism which feeds masking tape to a position adjacent the adhesive side of the sealing tape and a mechanism which applies the end of the masking tape to the adhesive side of the sealing tape and cuts the masking tape to thereby form the segment of masking tape.

In the preferred embodiment of the invention, the taping apparatus is adapted to sequentially apply segments of sealing tape of uniform lengths to a number of containers and to form pull-tabs at both ends of the sealing tape segments so applied. The containers are carried on a conveyor at uniform spacings thereon. The sealing tape applying assembly includes a lay-down roller which is biased against an end portion of the container to thereby press the sealing tape to the leading edge of such end portion of one container and to iron the tape onto the container as the sealing tape is pulled by the moving container. The sealing tape is thereafter applied in the same manner to an end portion of the next container on the conveyor, thereby providing a linking segment of sealing tape which is suspended between the adjacent two containers. The segments of masking tape are applied to the sealing tape at intervals thereon selected to position each masking tape segment midway on the linking section of sealing tape. The sealing tape cutting assembly is situated downstream from the lay-down roller and is actuated, when the conveyor is stopped, to cut the linking tape segment through the masking tape segment. Preferably, a pair of additional lay-down rollers is incorporated in the sealing tape cutting assembly so as to operate synchronously with the tape cutting assembly to press the respective loose portions of the severed linking section of the sealing tape onto the sides of the respective adjacent containers. Since the segment of masking tape is severed along with the sealing tape, the severed portions of the masking tape segment form pull-tabs at the ends of said cut portions of the linking section of sealing tape.

BRIEF DESCRIPTION OF THE DRAWINGS

FIG. 6 is an enlarged sectional view taken on line 6—6 of FIG. 2.

FIG. 7 is a fragmentary top plan view illustrating the arrangement of the sealing tape cutting assembly and the associated lay-down rollers of the taping apparatus at the left side of the conveyor at a point in time just before the sealing tape is cut and applied to the opposing side panels of adjacent cartons on the conveyor.

FIG. 8 is a fragmentary top plan view similar to FIG. 7 but depicting the extended arrangement of the tape cutting assembly after the sealing tape has been cut and applied to the side panels of the cartons.

FIG. 9 is a schematic view illustrating the pneumatic control circuitry of the taping system of the present invention.

DESCRIPTION OF THE PREFERRED EMBODIMENT

Figure 1:
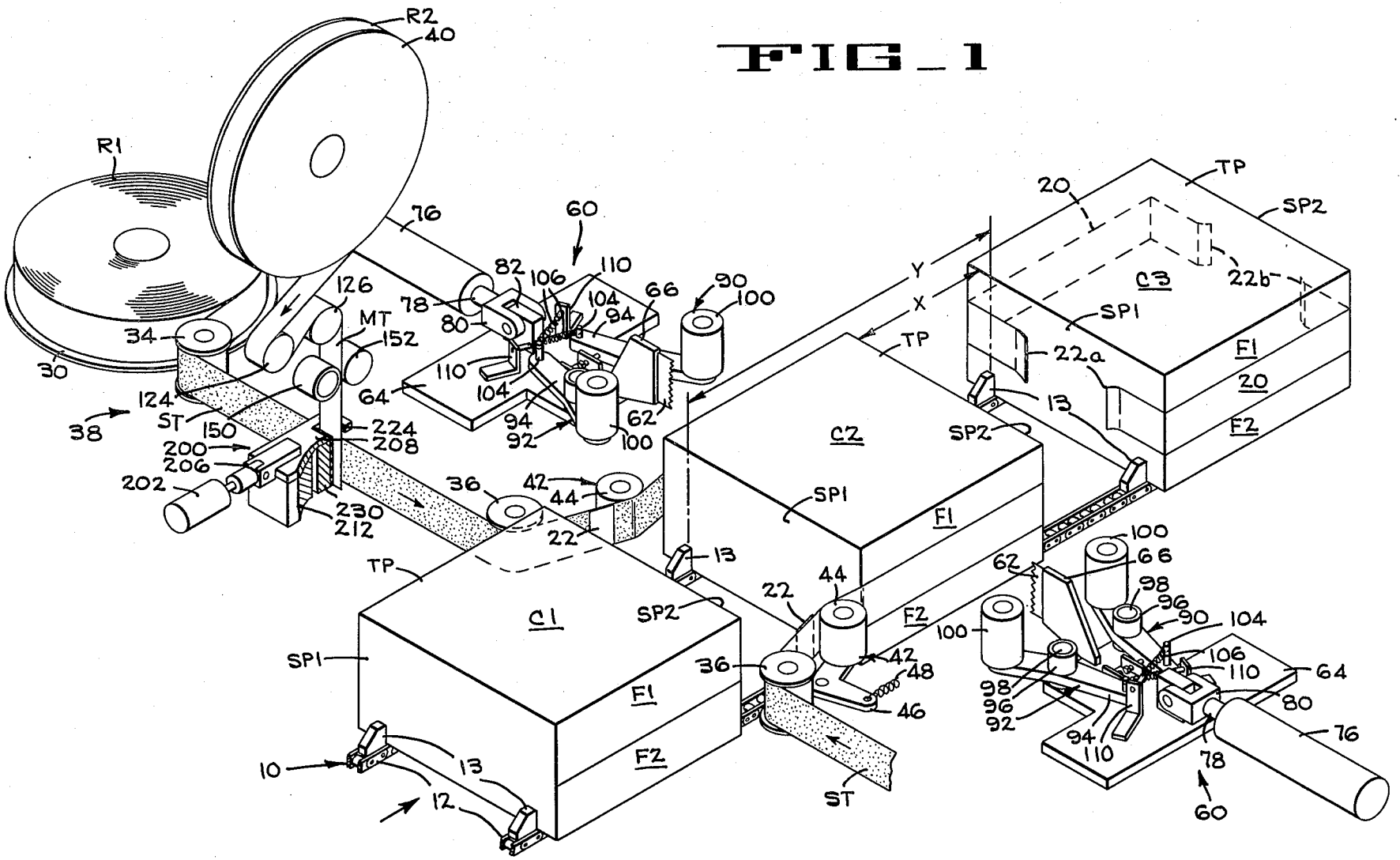
FIG. 1 is a diagrammatic, isometric view of a preferred embodiment of the taping system of the present invention, which is adapted to apply sealing tape to opposite ends of a series of cartons, with only the lay-down roller assembly and the sealing tape cutting assembly of the taping apparatus at the right side of the carton conveyor being depicted.

Referring now to FIG. 1, a taping system for applying tape segments 20 to the ends of rectangular cartons C1, C2, C3 and forming pull-tabs 22*a* and 22*b* at the ends of such segments will be seen to include a chain conveyor 10 which includes a pair of chains 12 having lugs, or abutments, 13 extending upwardly therefrom at uniform intervals Y thereon. The chain conveyor is of a conventional form and is shown only in part. The motion of the conveyor is indexed by a camming arrangement as shown in FIG. 9 and discussed hereinafter, to cause the conveyor to intermittently convey the cartons to be taped such that, when the conveyor is stopped, the cartons are positioned in a position whereat the opposing tape cutting assemblies 60 may be actuated to sever the linking segments of sealing tape ST through the center of a masking tape segment 22 applied thereto, as will be described in detail hereinafter. It should be noted at this point that in FIG. 1 the chain conveyor is being driven to apply sealing tape ST to the cartons, while in the operational views of FIGS. 7 and 8 the chain conveyor is stopped.

As also shown in FIG. 1, the series of cartons C1, C2 and C3 are conveyed on conveyor 10 with the lugs 13 engaging the rear side panels SP1 of the cartons. The cartons each include a top panel TP, a bottom panel, the rear side panel SP1, a front side panel SP2, top end flaps F1 extending from the ends of the top panel, and bottom end flaps F2 extending from the ends of the bottom panel. The cartons also include flaps (not shown) beneath each of the end flaps F1 and F2 to which the end flaps F1 and F2 are glued. The cartons are positioned in laterally aligned relationships on the conveyor 10 with the end flaps F1 and F2 oriented so as to extend in the direction of travel of the conveyor. The cartons are conveyed with uniform intervals X, therebetween, which, of course, equals the spacing Y between the lugs 13 less the length of the top or bottom panels. The interval X between adjacent cartons is selected according to the desired length of the segments of sealing tape to be applied to the opposing side panels SP1 and SP2.

As shown in FIG. 1, with respect to the first carton C3, the taping apparatus is adapted to apply segments 20 of pressure-sensitive sealing tape across both end flaps F1 and F2 of a carton and partially along the side panels SP1 and SP2 thereof and also to form pull-tabs 22*a* and 22*b* at both ends of both of the segments 20 of sealing tape. The sealing tape is continuously applied to the end flaps of the adjacent cartons on the conveyor 10 to form linking segments of sealing tape between adjacent cartons on the conveyor, such as illustrated with respect to cartons C1 and C2 in FIG. 7. The linking segments of sealing tape are then cut through their centers, and the cut halves of the linking tape segment are applied to the opposing side panels of the adjacent cartons. Thus, it will be appreciated that the length of the tape segments 20 applied to the cartons corresponds to the interval Y (FIG. 1) between the lugs 13 of the conveyor.

Pull-tabs 22*a* and 22*b* are formed at the ends of the segments 20 by first applying short segments 22 of masking tape MT, such as plain paper tape without any adhesive thereon, at uniform intervals Y on the sealing tape ST (FIG. 1). The segments 22 of masking tape are, of course, applied to the adhesive side of the sealing tape, which is indicated by stippling in the drawings. Each masking tape segment 22 is applied to a sealing tape when the conveyor 10 is stopped and at the time when such sealing tape is positioned to be severed by an assembly 60, as will be hereinafter described in detail. A masking tape applicator assembly 38 is positioned at a fixed position relative to each of the cutting assemblies (one only shown in FIG. 1) to apply the segments of masking tape at the selected intervals which are equal to the spacings Y between the lugs 13 on the chain conveyor. When the conveyor is stopped with the last-applied tape segment 22 properly positioned to be cut by an assembly 60, as shown in FIG. 7, the next segment 22 of masking tape is then applied to the sealing tape.

As shown in FIG. 1, the taping system includes apparatus mounted adjacent both side margins of the conveyor 10 for simultaneously applying the sealing segments 20 to both ends of the cases and for simultaneously forming pull-tabs 22*a* and 22*b* at the ends of the two segments 20 applied to each case. The apparatus at each side of the conveyor are of identical (mirror image) construction, and thus only the structure of the apparatus at the left side (shown in full in FIG. 1) will be hereinafter described.

Figure 2:
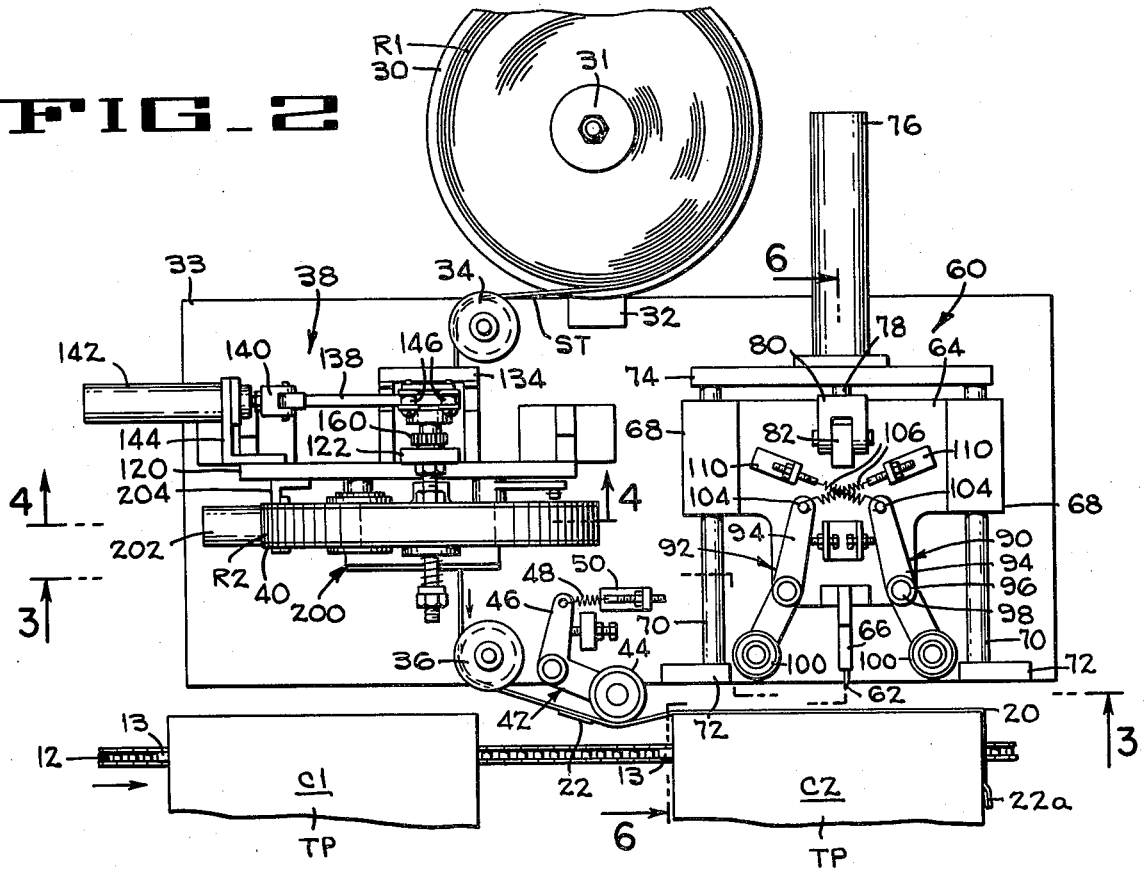
FIG. 2 is a fragmentary top plan view of the taping apparatus shown in FIG. 1 which is at the left side of the conveyor.

It will be seen in FIG. 1 that the sealing tape ST is supplied from a roll R1 horizontally supported on a reel 30. As shown in FIG. 2, the reel 30 includes a hub assembly 31 which is rotatably mounted to an underlying bracket 32 which, in turn, is mounted to a horizontal support plate 33. As diagrammatically shown in FIG. 1, the sealing tape ST is fed from the roll R1 over a first flanged guide roller 34 and thereafter over a second flanged guide roller 36. The guide rollers 34 and 36 are rotatably mounted to the support plate 33 (FIG. 2), with the second guide roller 36 being adjacent the inner margin of the support plate 33 and adjacent the chain conveyor 10.

The masking tape applicator assembly 38 (FIG. 2) is positioned midway between the guide rollers 34 and 36 and receives masking tape MT from a roll of masking tape R2 mounted on an overhead reel 40. As is hereinafter described in greater detail, the masking tape applicator assembly first presses an end section of the masking tape MT against the adhesive side of the sealing tape ST and then cuts the masking tape immediately above the sealing tape to thereby provide the short segment 22 of masking tape on the sealing tape.

The sealing tape ST having the masking tape segment 22 applied thereto is fed from the second guide roller 36 to a spring-biased lay-down roller assembly 42 for ironing the tape onto the ends of the cartons. As best seen in FIG. 2, the lay-down roller assembly 42 comprises a roller 44 rotatably mounted to the end of an arm of a bell crank 46. The bell crank 46 is rotatably mounted on a pin secured to the support plate 33 such that the roller 44 is downstream (relative to the conveyor movement) from the guide roller 36. The other arm of the bell crank 46 is engaged by a spring 48 which is adjustably mounted to a bracket 50 by an adjusting bolt. The lay-down roller 44 presses the sealing tape against the downstream end of the end flaps F1 and F2 of a carton, thereby ironing the sealing tape onto the end flaps as the carton is propelled on the conveyor. It will be seen in FIG. 1 that the roller assembly 42 has just completed ironing tape onto the end flaps of the passing carton C2. In FIG. 7 the cartons are illustrated in a subsequent (stopped) position whereat the roller assembly 42 has applied the sealing tape to downstream postions of the end flaps of the following carton C1. It will be noticed in FIG. 7 that a linking segment of sealing tape is thus suspended between the adjacent cartons C1 and C2 and that the adjacent cartons have been moved into positions such that the linking tape segment may be cut through the center of the masking tape segment 22 to form the pull-tabs 22*a* and 22*b*. Subsequent to such cutting, the cut halves of the linking tape segment are ironed onto the opposing side panels SP1 and SP2 of the adjacent cartons.

As illustrated in FIGS. 1, 6 and 7, the assembly 60 for cutting the linking segment of sealing tape ST and applying it to the side panels SP1 and SP2 of the cartons is mounted to the support plate 33 downstream from the applicator roller assembly 42. The tape cutting and applying assembly 60 includes a serrated blade 62 which is vertically mounted to the leading end of a slide plate 64 (FIG. 6) by means of an upstanding bracket 66. Referring to FIGS. 2 and 7, it will be seen that the slide plate has a pair of ball bushings 68 mounted at the sides thereof. The ball bushings 68 are slidably mounted on parallel guide shafts 70 which are secured between a pair of vertical bars 72 and vertical plate 74. As shown in FIGS. 7 and 8, the shafts 70 extend in a direction which is perpendicular to the direction of travel of the conveyor 10 and thus the linking segment of tape which is to be cut. As depicted in FIG. 8, the inner end of the slide plate adjacent the conveyor is cut away at the sides thereof so that such inner end is insertable between the cartons C1 and C2 on the conveyor. The slide plate is driven by a penumatic cylinder 76 which is mounted to the vertical plate 74 with the piston 78 thereof extending through a bore in the center of the vertical plate (FIG. 6). The piston 78 has a clevis coupling 80 at the end thereof which is secured to a bracket 82 extending vertically from the slide plate. The cylinder 76 is actuated in synchronization with the indexed movement of the conveyor 10 as will be hereinafter described after the conveyor has been stopped so as to drive the knife blade 62 against the center of the linking segment of sealing tape to thereby cut such sugment in half and also sever the masking tape segment 22 into two pull-tabs 22*a* and 22*b* at the severed ends of the segment of sealing tape.

As best seen in FIGS. 2 and 7, a pair of lay-down roller units 90 and 92 for ironing the severed ends of the sealing tape to the side panels SP1 and SP2 of the adjacent cartons are pivotally mounted to the projecting end of the slide plate 64 to project inwardly toward the conveyor 10. Each of the lay-down roller units 90 and 92 includes a bell crank 94 which has a sleeve 96 extending upwardly at the fulcrum thereof that is rotatably received on a shaft 98 extending vertically from the slide plate 64. A lay-down roller 100 is rotatably mounted to a shaft extending upwardly from the projecting end of the bell crank 94 of each lay-down roller assembly. A stub shaft 104 extends vertically from the opposite end of each bell crank 94 and a coil spring 106 is connected between the stub shaft 104 and an adjusting bolt secured to a bracket 110 mounted to the slide plate. The spring 106 of each lay-down roller assembly biases the roller 100 of the assembly against the side panel SP1 or SP2 of the carton. As illustrated in FIGS. 7 and 8, when the pneumatic cylinder 76 is actuated to move the slide plate 64 toward the conveyor, the lay-down rollers 100 are first pressed against the sealing tape ST immediately inwardly of the corners of the cartons, thereby stretching the linking segment of tape so as to assure a clean cut. Then the serrated blade 62 is ploughed through the tape so as to bisect the masking tape segment 22 to form the pull-tabs 22*a* and 22*b* at the ends of the cut tape. As shown in FIG. 8, the slide plate 64 is driven until the lay-down rollers have fully applied the cut ends of the sealing tape against the opposing side panels SP1 and SP2 of the cartons.

Figure 3:
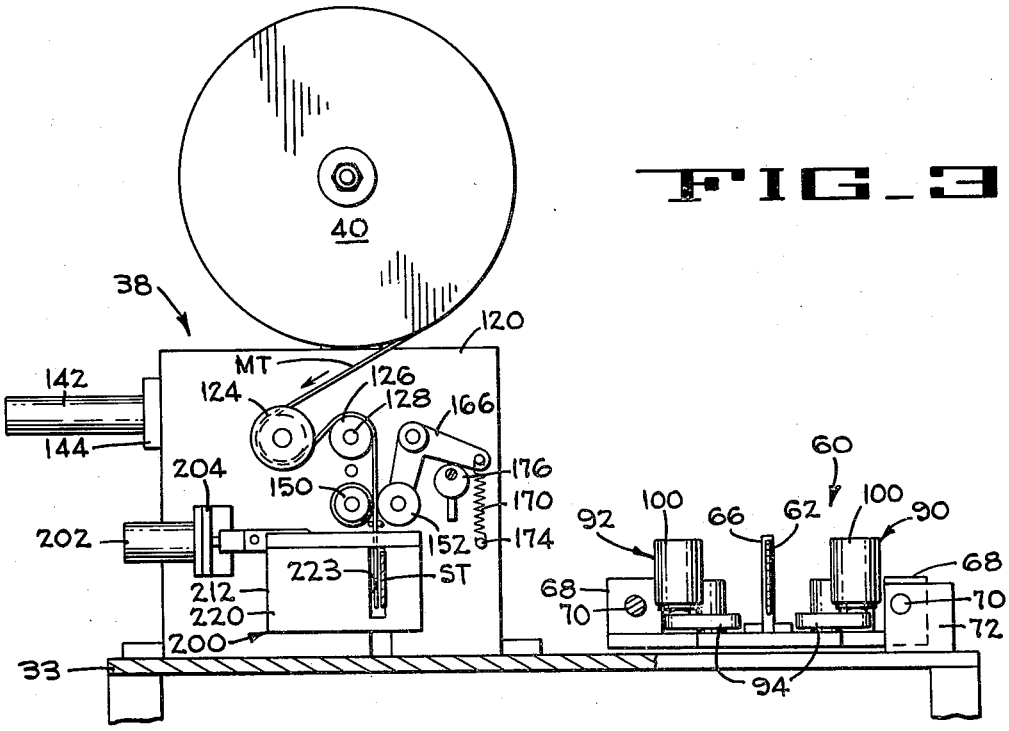
FIG. 3 is a sectional view taken on line 3—3 of FIG. 2.
Figure 4:
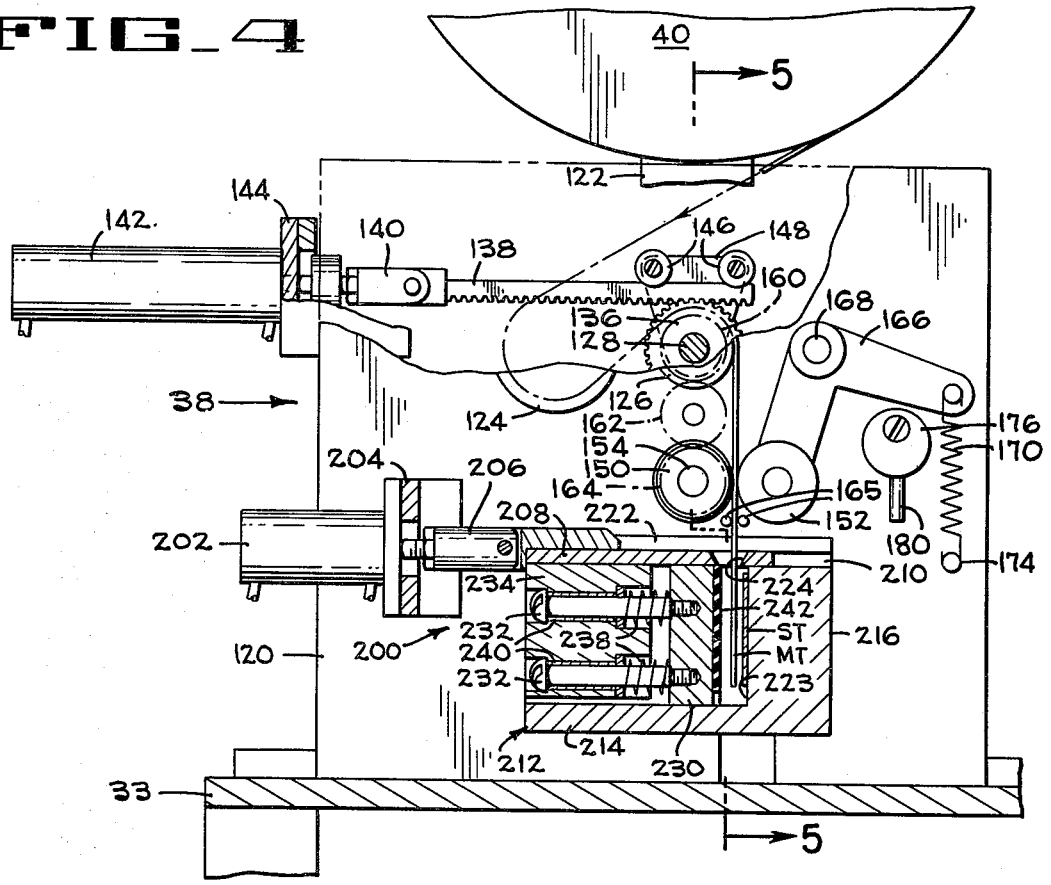
FIG. 4 is an enlarged sectional view taken on line 4—4 of FIG. 2.
Figure 5:
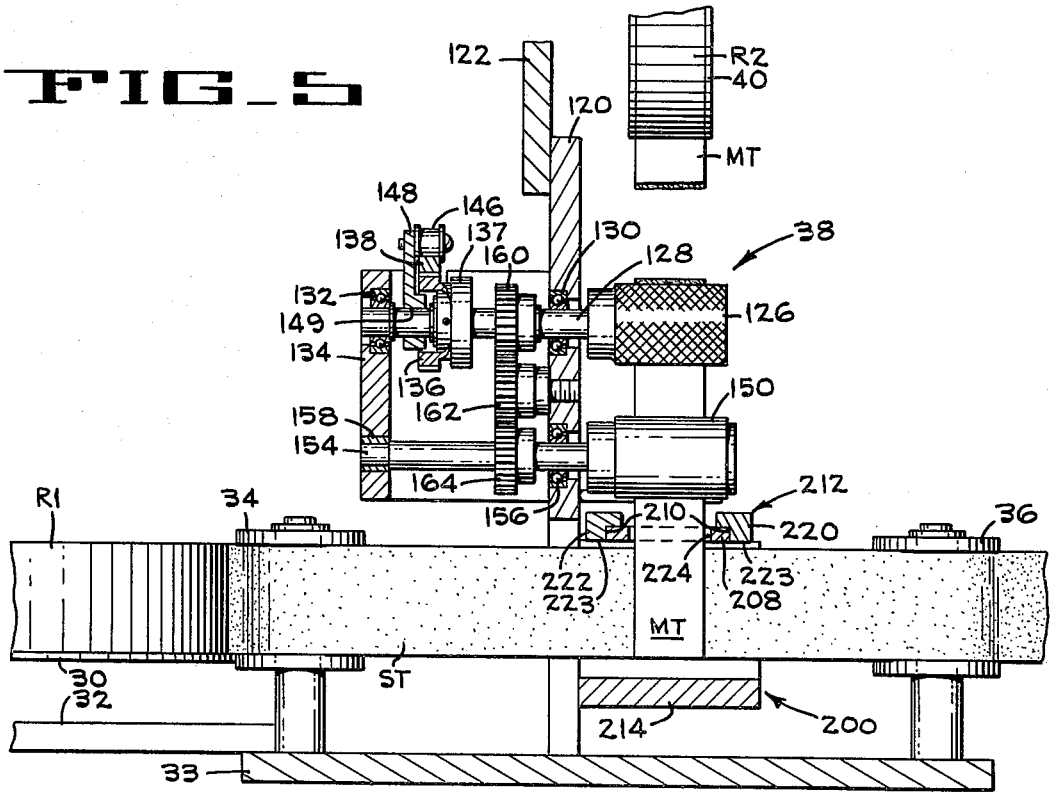
FIG. 5 is a sectional view taken on line 5—5 of FIG. 4.
Figure 5:
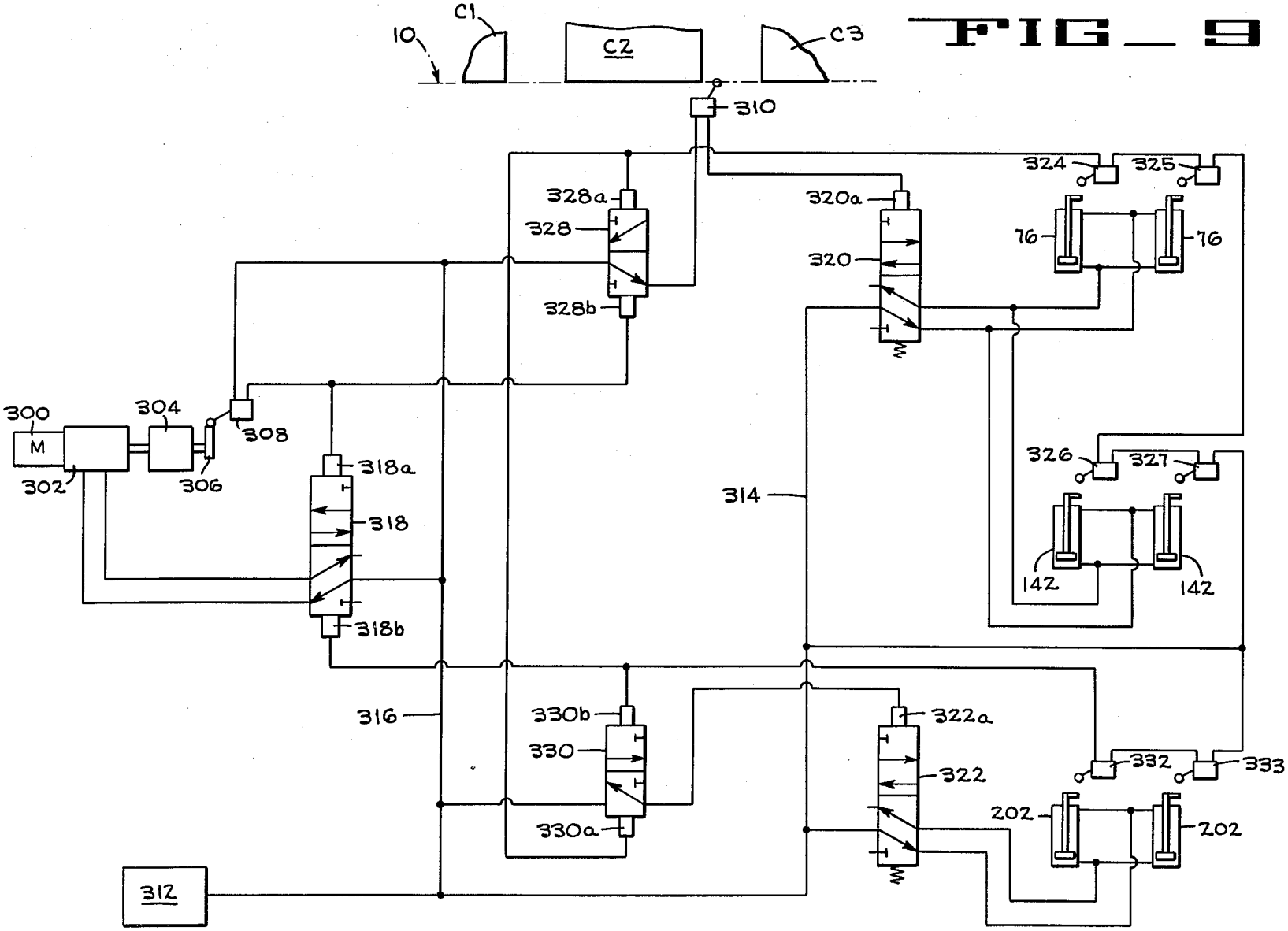

Next referring to FIGS. 2–5, the assembly 38 for applying the segments 22 of masking tape at uniform intervals on the sealing tape ST will be seen to include a tape cutting assembly 200 (FIG. 4) for cutting the masking tape segment from the roll R2 and a feeder assembly for supplying masking tape from the roll to the cutting assembly. The feeder assembly includes a support plate 120 which is vertically mounted to the support plate 33. The reel 40, upon which the roll R2 of masking tape is received, is rotatably mounted to a shaft extending from a bracket 122 which is connected at its lower end to the upper end of the support plate 120 (FIGS. 4 and 5). As best seen in FIG. 3, a flanged roller 124 is rotatably secured to the support plate 120. The masking tape MT is looped around the flanged roller 124 and is thereafter received over a knurled drive roller 126. The drive roller 126, as best illustrated in FIG. 5, is mounted on a shaft 128 which extends through a bearing 130 received within a counterbored opening in the support plate 120. The opposite end of the shaft 128 is received within a bearing 132 supported in an opening in a U-shaped bracket 134 (FIGS. 2 and 5) which is attached to the support plate 120. A pinion gear 136 (FIG. 4) is affixed to a one-way clutch 137 which, in turn, is coupled to the shaft 128. The pinion gear is engaged by the teeth of a rack 138, which is connected by a coupling 140 to the piston of a pneumatic cylinder 142. The pneumatic cylinder is horizontally mounted to the support plate 120 by a bracket 144 (FIG. 4). The smooth upper surface of the rack 138 bears against a pair of follower rollers 146 which are mounted to a V-shaped bracket 148 (FIGS. 4 and 5). The roller bracket 148 has a bore 149 formed in the lower end thereof which is loosely received on the shaft 128. The follower rollers 146 are flanged to guide the rack relative to the gear 136. When the piston in cylinder 142 is extended the rack 138 rotates the pinion gear, and the pinion gear acts through the drive clutch 137 to turn the drive roller 126 to dispense a selected length of masking tape. On the return stroke of the rack 138, the clutch 137 disengages so as to permit the rack to fully retract without turning the drive roller.

As illustrated in FIGS. 4 and 5, a pair of pinch rollers 150 and 152 are mounted to the support plate 120 below the drive roller 126 for receiving the masking tape MT therefrom. One roller 150 of the pair of pinch rollers is mounted directly below the drive roller on a shaft 154 which extends through a bore in the support plate 120 and is received within a bearing 156 engaged within a counterbore in said support plate bore. The other end of the shaft 154 is received within an oil-impregnated bushing 158 received within a bore in the bracket 134. Pinch roller 150 is driven by the rotation of the drive shaft 128 by means of a gear train consisting of a first gear 160 secured to the drive shaft 128, on idler gear 162 rotatably mounted to the support plate 120 to engage the first gear 160, and a driven gear 164 affixed to the shaft 154 of the pinch roller 150 and arranged to be engaged by the idler gear 162.

The pinch roller 150 has a sleeve of rubber applied thereto, and the tape engaging surface of the other pinch roller 152 is knurled to thereby firmly hold the masking tape between the two rollers. A pair of guide pins 165 (FIG. 4) is provided directly below the bite of the rollers. The knurled pinch roller 152 is rotatably mounted to the downwardly entending arm of a bell-crank 166 (FIG. 4). The bell crank 166 is pivotally mounted to a stub shaft 168 extending from the support plate 120. The other arm of the bell crank 166 has a stub pin extending therefrom to which a spring 170 is connected, with the other end of the spring being attached to a pin 174 extending from the support plate 120. To initially feed the masking tape between the pinch rollers, the knurled roller 152 is separated from the stationary roller 150 by a stop cylinder 176 which is eccentrically mounted for rotation on a pin mounted to the support plate below the spring-loaded arm of the bell crank 166. The cylinder 176 has a handle pin 180 extending radially therefrom which may be engaged to rotate the cylinder to lift the spring-loaded arm of the bell crank and thereby separate the pinch rollers 150 and 152.

As illustrated in FIGS. 2–5, the tape cutting subassembly 200 of the assembly 38 includes a pneumatic cylinder 202 mounted by a bracket 204 to the support plate 120. As best seen in FIG. 4, the piston of the cylinder 202 is connected by a coupling 206 to a slide plate 208. The slide plate 208 is engaged in opposing grooves 210 formed in the upstanding walls 220 and 222 of a rectangularly shaped housing 212, as shown in FIG. 5. The housing 212 further includes a bottom wall 214 and an end wall 216 (FIG. 4). A slot 223 (FIGS. 4 and 5) is formed in the housing to extend therethrough parallel to the end wall 216, and the housing 212 is mounted to the support plate 120 at a height such that the slot 223 registers with the sealing tape ST extending between the guide rollers 34 and 36. The slide plate 208 has a slot 224 (FIG. 1) formed transversely therethrough. As best seen in FIG. 4, the lower edge of the slot 224 which is positioned to be received upon the upper face of the end wall 216 of the housing 212 is sharpened into a knife edge so that it cooperates with the opposing inner and upper edge of the end wall 216 (FIG. 4) to cut the end portion of the masking tape when the slide plate 208 is driven against the masking tape MT by the cylinder 202. Thus, after the masking tape is fed through the slot 224, the cylinder 202 may be actuated to cut off the end portion of the tape to form the segment 22.

As seen in FIG. 4, a pressure plate 230 is resiliently mounted beneath the slide plate 208 such that the pressure plate presses the end portion of the masking tape MT against the adhesive side of the sealing tape ST just before the masking tape is cut by the slide plate. The pressure plate is resiliently mounted by means of two bolts 232 which are received within bores in a bracket 234 depending from the slide plate. The bracket bores are enlarged at their inner ends to receive spring retainer washers and springs 238 which are compressed between the pressure plate and the bracket 234. The bolts are received in bushings 240 in the bracket 234. A strip 242 of resilient material is adhered to the working surface of the pressure plate to assure that the pressure applied against the masking tape is evenly distributed thereover. When the cylinder 202 is actuated to extend the slide plate 208, the resiliently mounted pressure plate 230 will first press the end portion of the masking tape MT inserted through the slot 224 against the adhesive side of the sealing tape ST to thus attach such end portion thereto. Thereafter, the knife edge at one side of the slot 224 in the slide plate will coact with the end wall 216 of the housing to cut the end portion of the masking tape immediately above the top edge of the sealing tape, thus forming the segment 22 of masking tape on the sealing tape.

Reference is now made more specifically to the pneumatic control circuit shown in FIG. 9. The taping apparatus of the present invention will be seen to include a conveyor drive assembly including an electric motor 300, a clutch-brake unit 302 connected to the output shaft of the electric motor, and a gear box 304 having an input shaft driven by the output shaft of the clutch-brake unit. The gear box has an output shaft to which a cam 306 is operatively connected, and (although not illustrated) it will be understood that the output shaft of the gear box also serves to drive the carton conveyor 10. The cam 306 actuates a trip valve 308 each time the conveyor 10 has brought a pair of adjacent cartons into a position (as shown in FIG. 8) such that the aforementioned linking segments of tape on both ends of the cartons may be cut and applied to the cartons, i.e., such that the masking tape segments are aligned with the knife blades 62. The control circuit further includes a trip valve 310 which is disposed between the chains 12 of the conveyor at a position downstream from the tape cutting assemblies 60 so as to determine whether a carton is present at such conveyor position and, if not (as shown in FIG. 9), to prevent the tape cutting assemblies from being actuated. The taping apparatus of the present invention further includes a source 312 of air under a regulated pressure which supplies air to operate the cylinders 76 of the opposing right and left tape cutting assemblies 60 (FIG. 1), the cylinders 202 of the right and left masking tape cutting assemblies 200 (with only the left assembly 200 and its cylinder 202 being shown in FIG. 1), and the cylinders 142 of the right and left masking tape applicator assemblies (FIG. 2, but again with only the left assembly 200 being shown). The source 312 of air under pressure communicates with such cylinders through a pressure line 314. Another pressure line 316 communicates with a relay valve 318 which is arranged to operate the clutch-brake unit 302 of the conveyor drive system. The line 316 is also connected to the inlet port of the trip valve 308. The power valve 320 is arranged to reversibly operate the pair of cylinders 76 of the opposing sealing tape cutting assemblies and, concurrently therewith, to reversibly operate the cylinders 142 of the masking tape applicator assemblies. In this manner, the cylinders 76 and 142 are concurrently operated to conjointly cut the linking segment to tape and apply the severed segments of tape to the cartons and to also feed the lower ends of the masking tapes MT into the cutting assemblies 200 in preparation for pressing such lower ends to the sealing tapes ST. The valve 320 is spring-biased so as to normally remain in a reverse-flowing condition and hence to normally maintain the pistons within cylinders 76 in retracted conditions. The operation of the cylinders 202 of the assemblies 200, which apply the lower end of masking tape to the sealing tape and cut the masking tape above the sealing tape, is controlled by another spring-biased power valve 322. The valve 322 is also arranged to reversibly operate the cylinders 202 and to normally remain in a reverse-flowing condition such that the pistons within cylinders 202 are normally in their retracted states. The valves 320 and 322 respectively include pneumatic actuators **320*a* and 322*a***.

The pistons within the two cylinders 76 on opposite sides of the conveyor, when fully extended, actuate a pair of limit valves 324 and 325. The pistons within the two cylinders 142, when fully extended, actuate another pair of limit valves 326 and 327. The four limit valves 324, 325, 326 and 327 are connected in series to the pressure line 314. The downstream valve 324 of these four valves has its outlet communicating with the actuator 328*a* of a further relay valve 328. The relay valve 328 has its inlet connected to the pressure line 316 and its outlet connected to the inlet of the limit valve 310. The relay valve 328 includes a counteracting actuator 328*b* which communicates with the outlet of the limit valve 308 so as to be actuated when the cam 306 has actuated the limit valve 308.

Thus, it will be seen that when the cam 306 actuates the valve 308, the actuator 328*b* of the relay valve 328 is energized so as to permit flow to the valve 310, and, when a carton is present on the conveyor, the flow proceeds through the valve 310 to actuate the actuator 320*a* of the valve 320 so as to, in turn, reverse flow to the cylinders 142 and 76 and thus simultaneously cut the linking segments of tape and feed the lower ends of the masking tapes into the slots 224 of the tape cutting assemblies 200. When the pistons of all these four cylinders have been fully extended so as to actuate the respective limit valves 324–327, the actuator 328*a* of the relay valve 328 is energized to interrupt flow to the actuator 320*a* of the valve 320 so as to permit the valve 320 to return to its normal reverse-flowing condition and thus retract the pistons of the four cylinders 76 and 142.

It will be seen that the outlet of the limit valve 308 also communicates with an actuator 318*a* of the relay valve 318 which operates the conveyor drive clutch-brake unit 302. When the actuator 318*a* is energized, such relay valve interrupts air flow from the pressure line 316 to the clutch port of the clutch-brake unit and permits air flow to the brake port thereof so as to brake the conveyor. Such braking occurs rapidly enough so that by the time the cylinders 76 and 202 are actuated, the conveyor has come to a halt and thus the movement of the sealing tapes through the cutting assemblies 200 has also been arrested.

The two cylinders 202 are actuated subsequent to the complete extension of the pistons of cylinders 76 and 142 by neams of a further relay valve 330 which has its inlet coupled to the pressure line 316 and an outlet operatively connected to the actuator 322*a* of the power valve 322. The relay valve 330 has a first actuator 330*a* which communicates with the downstream limit valve 324 of the series of limit valves 324–327. Accordingly, when all of such four limit valves 324–327 are actuated, the actuators 330*a* and 328*a* of the relay valves 330 and 328, respectively, are simultaneously energized. When this occurs, the valve 320 is operated to reverse the flow to the two sets of cylinders 76 and 202, and the valve 322 is concurrently actuated to reverse the flow to the set of cylinders 202 to thereby simultaneously retract the pistons within the cylinders 76 and 142 and extend the pistons within the set of cylinders 202. The piston of the cylinder 202 of the left side masking tape cutting assembly 200 is arranged to actuate a limit valve 332 when it is fully extended, and the piston of the cylinder of the counterpart right side assembly is adapted to actuate a limit valve 333 when it is fully extended. The limit valves 332 and 333 are connected in series between the pressure line 314 and a counteracting actuator 330*b* of the relay valve 330. Accordingly, when the cylinders 202 are fully extended after the lower end of the masking tape has been applied to the sealing tape and has been cut to form a masking tape segment 22, the relay valve 330 interrupts flow to the actuator 322*a* of the valve 322 so as to permit the valve to return to its normal reverse-flowing condition and thus retract the pistons within cylinders 202.

The outlet of the downstream valve 332 of the two limit valves 332 and 333 is also connected to the other actuator 318*b* of the relay valve 318. When the actuator 318*b* is energized, the relay valve 318 interrupts flow to the brake line of the clutch-brake unit 302 and permits flow through the clutch line thereof thereby starting the conveyor and initiating another tape applying sequence. Thereafter, the aforedescribed sequence is repeated starting with the actuation of trip valve 308 by the cam 306.

Although the best mode contemplated for carrying out the present invention has been herein shown and described, it will be apparent that modification and variation may be made without departing from what is regarded to be the subject matter of the invention.

What is claimed is:

1. An apparatus for sequentially applying segments of sealing tape of uniform preselected lengths to series of containers and for forming a pull-tab at an end of each of the segments so applied comprising: means for dispensing sealing tape from a roll thereof: means for receiving sealing tape from said dispensing means and for applying the sealing tape to a container in said series; means for cutting the sealing tape applied to the container after a preselected length of the tape has been applied; means for dispensing masking tape from a roll thereof; and means for applying an end portion of the masking tape to the adhesive side of the sealing tape and for cutting such end portion to form a masking tape segment on said sealing tape; said masking tape applying means being mounted between said sealing tape applying means and said sealing tape dispensing means and in a position relative to said sealing tape cutting means such that the sealing tape extending between said sealing tape cutting means and said masking tape applying means corresponds to said preselected length of sealing tape to be applied to the container, whereby said sealing tape cutting means may be sequentially actuated to cut the sealing tape at the masking tape segment applied thereto to provide a pull-tab which is at the end of the segment of sealing tape applied to the container.

2. The apparatus according to claim 1 further comprising conveyor means for carrying the containers in uniformly spaced relationships along a direction of travel; said means for applying sealing tape to the containers including roller means for ironing the sealing tape to the containers, with the sealing tape being pulled from said sealing tape dispensing means as a container having the tape applied thereto is carried past said roller means; and said means for cutting the sealing tape and said means for applying and cutting the masking tape being positioned respectively downstream and upstream from said roller means.

3. The apparatus according to claim 2 further comprising means for indexing the movement of said conveyor means, and control means for actuating said sealing tape cutting means and said masking tape applying and cutting means in synchronization with the movement of said indexing means so as to cut the sealing tape and form a masking tape segment on the sealing tape when said conveyor means is stopped.

4. The apparatus according to claim 1 wherein said means for applying the end portion of the masking tape to the adhesive side of the sealing tape includes means for guiding the end portion of the masking tape along a path transverse to the sealing tape and closely spaced from the adhesive side of the sealing tape; said masking tape dispensing means including drive means operable in one direction only to dispense a length of masking tape approximately equal to the width of the sealing tape; said dispensing means being mounted to dispense said length of tape so that the end of the masking tape registers with an edge of the sealing tape when said drive means is actuated; and said means for cutting said end portion of the masking tape including blade means reciptocatably mounted to cut the masking tape immediately adjacent the other edge of the sealing tape.

5. The apparatus according to claim 4 further comprising conveyor means for carrying the containers to be taped in uniformly spaced relationships; means for indexing the movement of said conveyor means; first control means responsive to said indexing means for actuating said means for cutting the sealing tape and for concurrently actuating said drive means of said means for dispensing the masking tape; and second control means responsive to said first control means for actuating said means for cutting the masking tape after the end portion of the masking tape has been dispensed to said edge of the sealing tape.

6. The apparatus according to claim 1 further comprising conveyor means for carrying the containers to be taped along a path of travel in uniformly spaced relationships; means for indexing the movement of the conveyor means such that said means for applying sealing tape to the containers applies the sealing tape to aligned portions of two consecutive containers on said conveyor means to form a linking section of sealing tape between said consecutive two containers on said conveyor means; said means for forming a masking tape segment on the sealing tape being positioned relative to said means for cutting the sealing tape to consecutively form said masking tape segments on said sealing tape so that each masking tape segment is provided on said linking section of sealing tape as said linking section is formed; and said sealing tape cutting means being positioned in a fixed relationship relative to said means for applying the masking tape segments so as to sever said linking tape section midway through each consecutive masking tape segment formed on the sealing tape whereby two pull-tabs are formed from each masking tape segment, one of said two pull-tabs being formed at the trailing end of the sealing tape applied to leading container of said two consecutive containers on said conveyor means and the other of said two pull-tabs being formed at the leading end of the sealing tape applied to the trailing container of said two consecutive containers on the conveyor means.

7. The apparatus according to claim 6 further comprising means which is mounted to said means for cutting the sealing tape for applying the loose portions of the linking tape section to opposing surface portions of said two consecutive containers.

8. An apparatus for sequentially applying segments of sealing tape to a number of containers and for forming pull-tabs on at least one of the ends of each tape segment applied to each container, said apparatus comprising: conveyor means for carrying containers along a path in uniformly spaced relationships; means for indexing the movement of said conveyor means; means for dispensing sealing tape from a roll thereof; roller means arranged to receive said sealing tape from said dispensing means for applying said sealing tape to a leading portion of a container on said conveyor means and for ironing the tape onto said container as said container is carried on said conveyor means; said indexing means being arranged to stop said conveyor means after the sealing tape has been applied to two consecutive containers on the conveyor means to thereby form a linking section of sealing tape extending between the two consecutive containers; means for cutting said sealing tape applied to said two consecutive containers by said roller means; first control means for actuating said cutting means when said conveyor means has been stopped by said indexing means; means for dispensing masking tape from a roll of masking tape; means which receives masking tape from said masking tape dispensing means for feeding the end portion of said masking tape to a position registering with the adhesive side of said sealing tape; second control means for actuating said masking tape feeding means concurrently with the actuation of said means for cutting the sealing tape; means for pressing the end portion of the masking tape against the adhesive side of the sealing tape and for severing the masking tape adjacent the edge of the sealing tape to thereby form a segment of masking tape on the sealing tape; third control means for actuating said pressing and severing means after said feeding means has been actuated; means for mounting said sealing tape cutting means, said roller means, and said masking tape pressing and severing means in fixed relationships relative to each other and to said conveyor means so as to form masking tape segments on said sealing tape at intervals thereon corresponding to the desired length of the segments of sealing tape to be consecutively formed on said containers, whereby said means for cutting the sealing tape will sequentially cut the sealing tape at a segment of masking tape thereby forming a pull-tab at an end of the sealing tape segments applied to the containers.

9. The apparatus of claim 8 wherein said indexing means is arranged to stop the conveyor means at a position whereat said means for cutting the sealing tape cuts through the center of a masking tape segment on the linking section of sealing tape, thereby forming from a single segment of masking tape a pull-tab at the downstream end of the tape applied to the upstream one of said consecutive containers on said conveyor means and another pull-tab at the upstream end of the tape applied to the downstream one of said containers.

10. The apparatus according to either claim 8 or claim 9 wherein said containers are carried on said conveyor means with substantial uniform spacings between the articles; and said means for cutting the sealing tape includes a blade, means for reciprocatably moving the blade to sever the linking section of sealing tape, and a pair of roller means mounted to said blade moving means for engaging the cut end portions of said linking section and for applying said cut end portions to opposing surface portions of the respective containers.

11. A method of applying segments of sealing tape of selected uniform lengths to containers and for forming a pull-tab on at least one end of each segment of sealing tape applied to the containers comprising:

dispensing sealing tape from a roll thereof;

applying relatively short segments of masking tape onto the adhesive side of the sealing tape at intervals corresponding to the preselected length of sealing tape to be applied to a container;

applying the sealing tape having a masking tape segment applied thereto to a first container;

cutting the sealing tape at a masking tape segment to form a pull-tab at the end of the sealing tape applied to the first container;

applying the preselected length of sealing tape having the following masking tape segment thereon to a second container; and cutting the sealing tape at said following masking tape segment, thereby sequentially providing containers with said selected lengths of sealing tapes and simultaneously providing pull-tabs at the ends of the tapes applied to the containers.

12. The method according to claim 11 wherein said sealing tape is cut through the masking tape segment to thereby provide two pull-tabs formed by complementary parts of each masking tape segment with one of said pull-tabs being formed at the trailing end of the sealing tape applied to the first container and with the other of said pull-tabs being formed at the leading end of the sealing tape applied to the second container.

* * * * *